US008026655B2

(12) United States Patent
Arndt et al.

(10) Patent No.: US 8,026,655 B2
(45) Date of Patent: Sep. 27, 2011

(54) LAMP WITH A BASE AT ONE END

(75) Inventors: Joachim Arndt, Brieselang (DE); Uwe Fidler, Berlin (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 239 days.

(21) Appl. No.: 12/454,606

(22) Filed: May 20, 2009

(65) Prior Publication Data

US 2009/0302736 A1 Dec. 10, 2009

(30) Foreign Application Priority Data

Jun. 6, 2008 (DE) ..... 20 2008 007 575

(51) Int. Cl.
*H01J 5/48* (2006.01)

(52) U.S. Cl. ..... 313/318.09; 313/312; 313/315; 313/317

(58) Field of Classification Search ..... 313/483–493, 313/623, 627–643, 567, 111–117, 25–27, 313/315–317, 318.01–318.09; 439/615, 439/739; 445/22, 24, 26, 29
See application file for complete search history.

(56) References Cited

U.S. PATENT DOCUMENTS

| | | | |
|---|---|---|---|
| 2005/0127807 A1 | 6/2005 | Arndt et al. | |
| 2006/0226754 A1 * | 10/2006 | Arndt et al. | 313/318.09 |
| 2008/0164803 A1 | 7/2008 | Arndt et al. | |

FOREIGN PATENT DOCUMENTS

| | | |
|---|---|---|
| DE | 43 17 252 C1 | 5/1993 |
| DE | 198 56 871 A1 | 12/1998 |
| DE | 199 14 308 A1 | 3/1999 |
| EP | 1 109 199 A2 | 6/2001 |
| WO | WO 2005/015605 A2 | 2/2005 |
| WO | WO 2005/015605 A3 | 2/2005 |

* cited by examiner

*Primary Examiner* — Nimeshkumar Patel
*Assistant Examiner* — Donald Raleigh
(74) *Attorney, Agent, or Firm* — Holtz, Holtz, Goodman & Chick, PC

(57) ABSTRACT

A lamp with a base at one end, in particular a high-pressure lamp, with a light bulb sealed in a vacuum-tight fashion, with the latter being surrounded by an outer bulb and an enveloping part, with a base supporting firstly the outer bulb and secondly the enveloping part, having the following features:

a) the base has a base insulator which is produced from an insulating material and has a central opening which holds the outer bulb;

b) the base insulator has a circular segment with a plateau;

c) the enveloping part has a circular opening with a radially projecting edge which has a lower and upper contact face relative to the base on the base side, the lower contact face of the edge fitting together with the upper plateau of the circular, radially projecting segment on the base insulator;

d) the enveloping part is attached to the base insulator by a cement-free mechanical holding mechanism, with an annular damping element being inserted between enveloping bulb and base insulator.

13 Claims, 4 Drawing Sheets

LAMP WITH A BASE AT ONE END

TECHNICAL FIELD

The invention relates to a lamp with a base at one end in accordance with the preamble of claim 1. These are in particular high-pressure discharge lamps, preferably metal-halide lamps, but also halogen incandescent lamps, for example. In this case, use is frequently made of an elongate, in particular ceramic, discharge vessel as a lamp bulb.

PRIOR ART

DE-C1 43 17 252 has already disclosed a lamp with a base at one end which comprises three bulbs. It has a ceramic adapter which is fitted to a screw-type base. Atmospheric pressure prevails between the enveloping bulb and the outer bulb.

EP 1 109 199 describes a high-pressure lamp with a base at one end, in which the outer bulb is surrounded by a reflector. The base is fastened directly to the reflector neck by means of crimping. One disadvantage of this is the fact that the dimensions of the neck of the reflector must be matched to the standard dimensions of the base.

WO2005015605 discloses a lamp with a base at one end which is of modular design.

DESCRIPTION OF THE INVENTION

It is the object of the present invention to provide a lamp with a base at one end in accordance with the preamble of claim 1, which lamp is easy to mount and is well-suited to being produced in an automated fashion.

This object is achieved by the characterizing features of claim 1. Particularly advantageous refinements can be found in the dependent claims.

It was found that lamps produced in a modular fashion require a damping element, in particular high pressure discharge lamps, advantageously those having a ceramic discharge vessel. Said damping element is inserted between the outer bulb and the base ceramic in order to prevent glass from breaking during the specific production processes. In particular, when joining an installation lamp or basic lamp, which often has a clip as a holder, into the shaft of a base ceramic, it is possible for the lower pinch region of the pinch of the basic lamp to be damaged when the latter is set onto the plateau of the base ceramic. Previously, a commercially available O-ring was used as a damping element in accordance with WO2005015605.

The lamp with the base at one end comprises a light bulb sealed in a vacuum-tight fashion, in particular an elongate discharge vessel which is possibly additionally housed in an outer bulb, with the light bulb, that is to say the discharge vessel or else the discharge vessel and outer bulb component, additionally being surrounded by an enveloping part. It is preferably a ceramic discharge vessel, in particular for a metal-halide lamp, for e.g. general illumination purposes. In this case, a base with electrical connectors supports firstly the lamp bulb and secondly the enveloping part. The electrical connectors are usually connected to electricity supply lines which make electrical contact with an illumination means in the interior of the light bulb; the illumination means being implemented, for example, by electrodes or an illumination body of an incandescent lamp. It is also possible for outer electrodes or an electrode-free configuration to be used without restricting the invention. It is possible for a discharge vessel made from silica glass or toughened glass to be used instead of a ceramic discharge vessel. An outer bulb is not absolutely necessary.

The combination of the following features is often used so that complicated frame mounting and hot processes such as smelting and baking the base cement can be dispensed with:

a) the base has a base insulator which is produced from an insulating material and has a central opening in which the light bulb is held in a cement-free fashion;
b) the base insulator has a radially projecting segment which, in particular, is circular, with an associated upper and lower plateau relative to the base,
c) the enveloping part comprises a base-side, in particular circular, opening with a radially projecting edge or edge section having a lower and upper contact face relative to the base, the lower contact face of the edge or edge section fitting together with the upper plateau of the radially projecting segment on the base insulator;
d) the enveloping part is attached to the base by a cement-free mechanical holding mechanism.

In particular, in a first embodiment, the enveloping part is attached by a clamping part bridging, in a holding fashion, the distance between the lower plateau of the base insulator and at least the upper contact face of the edge.

Without limiting the invention, the enveloping part and the clamping part can form a unit in a second embodiment, with the holder of the enveloping part being implemented in the upper part of the base insulator, for example by crimping.

In addition to the base insulator, the base has a conventional part facing the lamp holder, for example a screw-type base attachment or a bayonet-type base attachment.

The lamp bulb, that is so say e.g. the outer bulb or the discharge vessel if there is no outer bulb, is preferably held in the central opening by means of a spring clip. In principle, this technique is known, see DE 198 56 871, for example.

In particular, the edge of the enveloping part and the segment of the base insulator are provided with an interacting anti-twist mechanism.

A simple, reliable and cost-effective solution for the holder of the enveloping part consists of the clamping part comprising clamps distributed around the circumference or an enveloping clamping band. In particular, the clamping band is a deformable ring which is produced out of metal or plastics in particular, so that a very simple holder is made possible by the clamping band first of all already being bent at the lower edge and it being pulled up over the base insulator to the projecting segment on impact. As soon as the enveloping part is placed, it is possible for the ring, preferably composed of aluminum, to be mechanically formed onto the segment and hence to be fixed to the edge of the enveloping part.

The prior art discloses inserting a damping means between the clamping part and the upper contact face of the edge of the enveloping part. In particular, this damping means is a type of O-ring, for example consisting of an elastomer. The material of the enveloping part, advantageously glass or aluminum, is protected from damage by said means during the forming process.

According to the invention, use is now made of a novel damping element. The damping element is formed integrally from a temperature-resistant, preferably elastic plastic. As a result of the shape of the damping element, which is integral where possible and preferably has a flat design, two main functions are implemented simultaneously: on the one hand, damping is implemented when an outer bulb and base ceramic are connected in a known fashion and at the same time, damping is ensured when a basic lamp is joined to a base ceramic. For this purpose, the damping element is designed as a ring, in which at least one web shoulder extends at two opposing points within the ring. The web shoulder is preferably designed as a continuous web which extends between the two web shoulders. However, it can also have a break in the middle so that two separate web shoulders are present. The web or the web shoulders can have guide holes, in particular for the electricity supply lines for the basic lamp or the like. The ring can preferably have one or more recesses, such as a latching groove, in order to ensure a desired orientation of the damping element with a correct alignment of the web shoulders. To this end, the lamp then has a corresponding counterpart, for example in the region of the base ceramic. The ring can also consist of two parts, preferably symmetric halves, which do not have to be connected to one another and which also do not have to form a complete ring.

In this case, the production process is carried out as follows:

The damping element (1) is placed onto the plateau of the base ceramic (2). Using a special mounting procedure, two materials which are sensitive to breaking, specifically the glass outer bulb (3) and the base ceramic (2), are mechanically connected by an aluminum ring (4). The base ceramic is preferably produced from steatite. In order to avoid breakage, the preferably integral damping element (1) is located between the two materials. Although the O-ring inserted on previous occasions also achieves damping and avoids breakage, it is, as a result of its shape, not necessarily positionally stable. This means it could slip, either already during the mounting or when the finished lamp is screwed into the lamp holder. This would result in an angled bulb or a loose bulb. This can no longer occur in the case of an integral, flatly-designed damping element (1).

The web shoulder is preferably drawn so far inward that it simultaneously also ensures damping when joining a basic lamp to a base ceramic. In this case, the following holds:

The damping element (1) is placed onto the plateau of the base ceramic (2). A basic lamp (7) provided with a clip (6) is joined to the shaft (8) of the base ceramic (2) using a suitable apparatus. The apparatus itself works using a solid stop. The overall length of the basic lamp varies as a result of the tolerance present which is mainly determined by the pinch lower edge (9) which runs freely toward the bottom. The solid stop of the joining apparatus is set once using existing basic lamps. The lower edge of the basic lamp pinch must be joined as closely as possible to the plateau (2) of the base ceramic but it must not contact the latter since this bears a high risk of cracks and flaking. In the case of relatively long basic lamps, the pinch lower edge (9) would be pressed onto the plateau of the base ceramic. Although the apparatus comprises a spring element for this case, the force required for the joining process can nevertheless damage the pinch.

A damping element (1) placed onto the plateau of the base ceramic (2) avoids this as far as possible.

In particular, Teflon or silicone rubber VMQ or Viton FPM can be used as materials for the damping element. The damping element should preferably have a thickness of between 0.5 and 1.5 mm, including edge values.

It is advantageous that, due to the damping element, the connecting force between the enveloping part and the segment is maintained without play throughout the service life of the lamp. As a result of the damping ring, the tension of the clamping part can be increased without risk and hence the connection can be designed in a more reliable fashion.

It is conventional for electricity supply lines, which are connected to the electrical connectors of the base, to be led out of the lamp bulb. A particularly flexible and time-saving solution consists of using clamping connectors for the connection between the electrical connectors and the electricity supply lines, as is known, for example, from DE-A 199 14 308.

The base usually also has one part facing the lamp holder which is at least in part connected to the base insulator in a known fashion by crimping. This part for example comprises a conventional screw thread.

By way of example, the enveloping part can be a closed part such as a further outer bulb which, however, is not sealed in a vacuum-tight fashion, or else a dome which has a reflector contour.

A typical application is a metal-halide lamp with a ceramic discharge vessel which contains a filling with or without a mercury component, possibly with an inert ignition gas, preferably a noble gas.

BRIEF DESCRIPTION OF THE DRAWINGS

In the following text, the invention is intended to be explained in more detail on the basis of a number of exemplary embodiments. In the figures.

PREFERRED EMBODIMENT OF THE INVENTION

Figure 1:
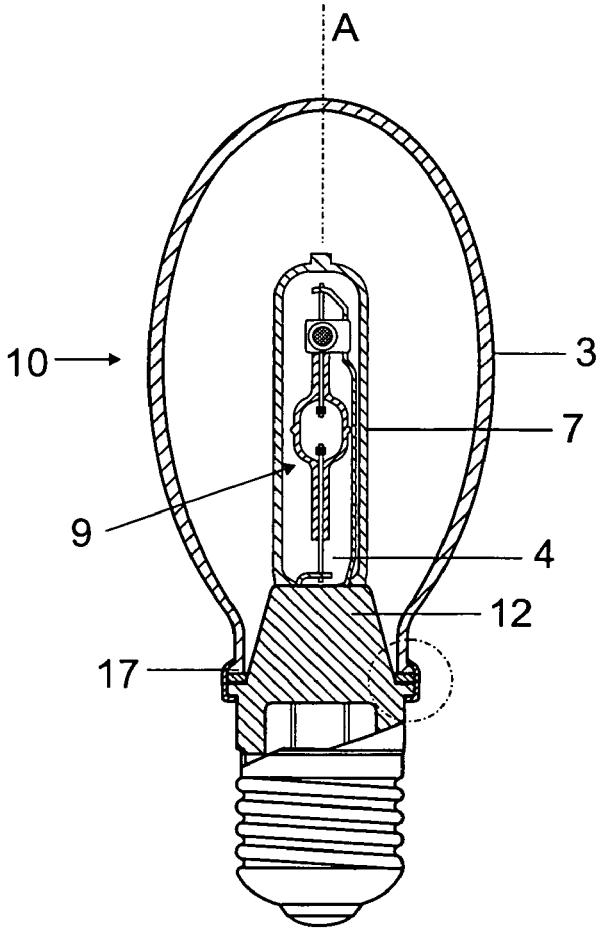
FIG. 1 shows a lamp according to the invention in assembled state.
Figure 3:
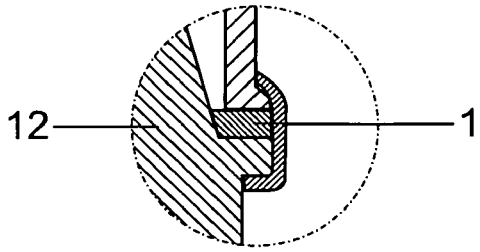
FIG. 3 shows an enlarged detail of the lamp.
Figure 2:
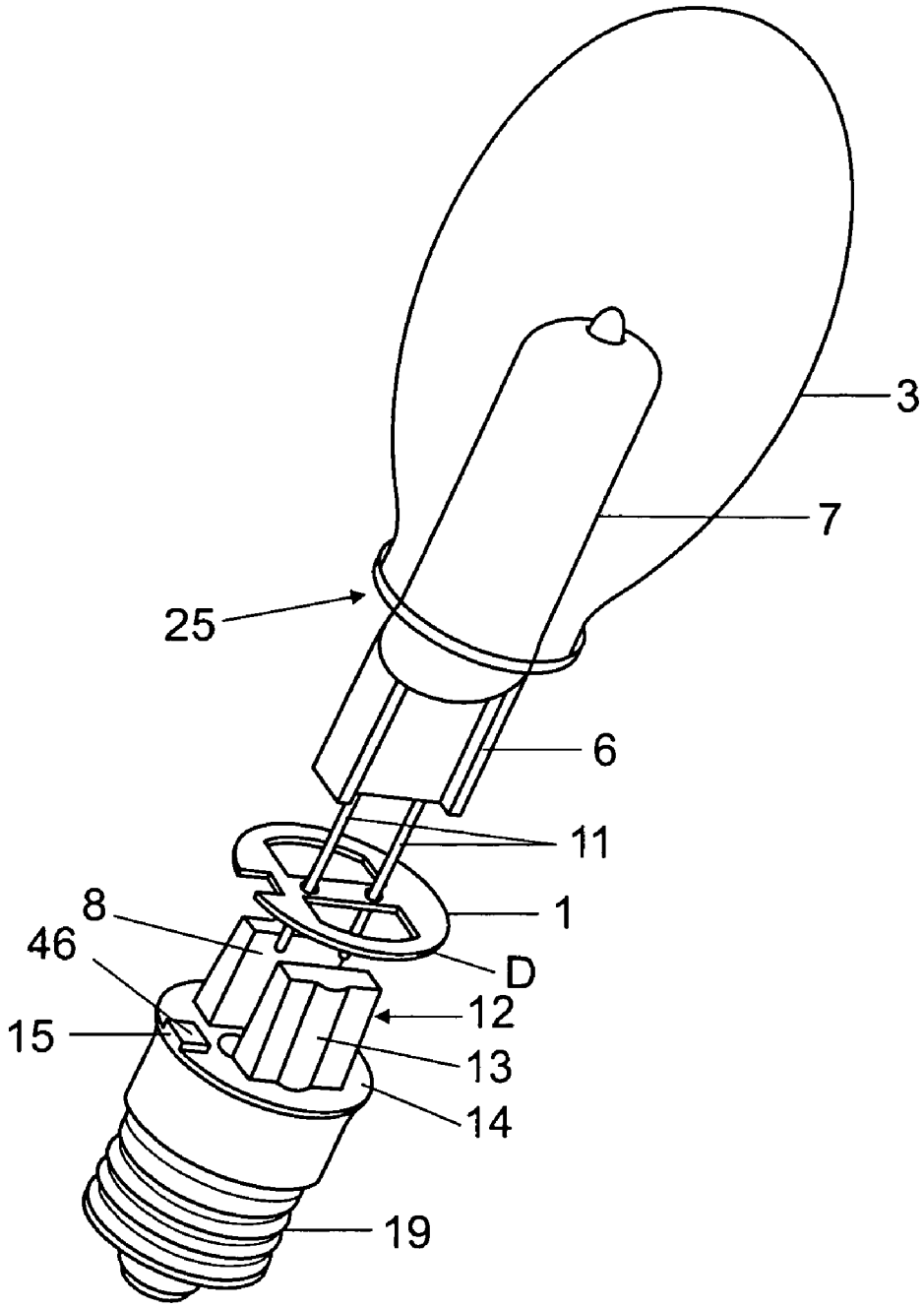
FIG. 2 shows the lamp of FIG. 1 in an exploded view.

FIGS. 1 and 2 show an exemplary embodiment of a metal-halide lamp 10 in an exploded view and in an assembled state. A ceramic discharge vessel 9, which is sealed on two sides, is arranged in an elongate fashion along the lamp axis A and surrounded by a further enveloping bulb 3. The discharge vessel 9 is tightly surrounded by an outer bulb 7 which is pinched on one side and is produced from toughened glass. A mount 4 with a short and long supply line holds the discharge vessel 9 in the outer bulb 7. The electrodes in the interior of the discharge vessel are connected to the supply lines by feedthroughs. Said supply lines are connected to the external electricity supply lines 11 in the region of a pinch 6 which seals the outer bulb 3. The pinch 6 of the outer bulb sits in a corresponding opening 8 of a ceramic base insulator 12 and is possibly held there by a metal clip in a known fashion (not illustrated) This opening 8 is surrounded by a central collar part 13. It protrudes out of a plane which is formed by the upper plateau 14 of a radially projecting disk-shaped segment 15. It sits on a neck part holding a lamp holder-facing part, in this case a screw-base part 19 with a thread. The neck part is hollow on the inside, the electricity supply lines 11 being connected to electrical connectors 21 of the base 23 of the neck part.

Figure 4:
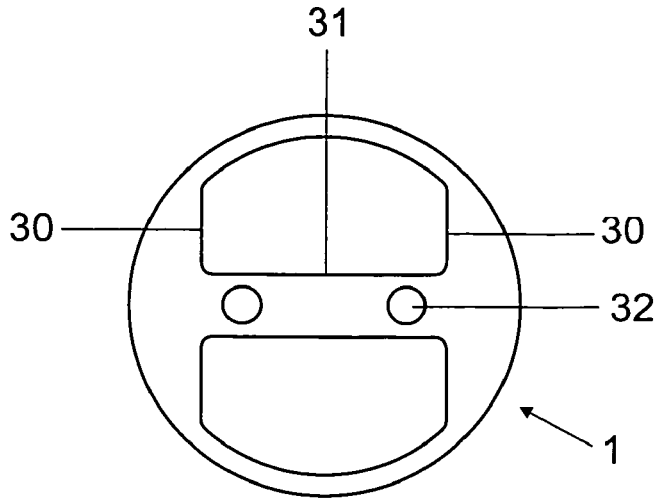
FIG. 4 shows a detail of the lamp, specifically the damping element.

The enveloping bulb 3, which surrounds the outer bulb 7 at a relatively large distance, has a base-side opening 25 which is circular cylindrical and the diameter of which is matched to the outer diameter of the segment 15. The damping element 1 is inserted between these two parts which are matched to one another in shape and size, said damping element for example being a ring cut out of a disk and having two opposing web shoulders 30 between which a web 31 extends, as shown in FIG. 4. Two bores 32 for the electricity supply lines of the basic lamp are provided in the web.

At its opening 25, the enveloping bulb 3 is provided with a radially projecting edge 27. It has a planar lower contact face which is matched to the upper plateau of the segment of the base insulator. The upper plateau can have humps which effect a spacing between the upper plateau and the enveloping bulb. Additionally, it has a narrow upper contact face which is aligned parallel to the lower contact face or else obliquely with respect to the latter. An elastomer ring, made of Viton® for example, is possibly seated on it; to this end, see WO 2005015605.

Figure 5:
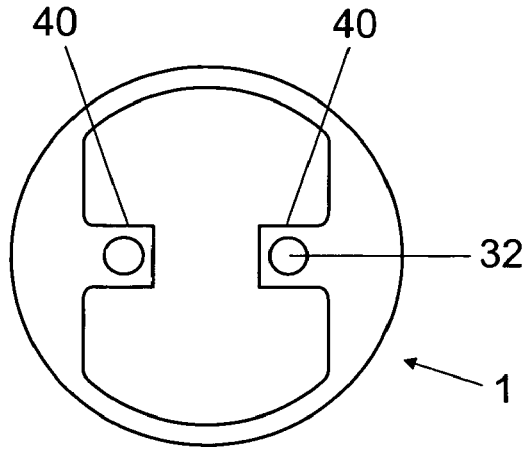
FIGS. 5-8 show a further exemplary embodiment of a damping element.

FIG. 5 shows a further exemplary embodiment of a damping element 1. In this case, no continuous web is provided; instead, an extended web stump 40 is respectively provided at the web shoulder, each web stump still having the bores 32.

Figure 6:
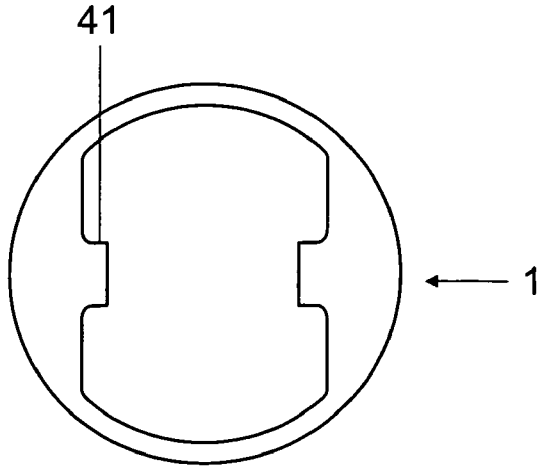

FIG. 6 shows an exemplary embodiment of a damping element 1 in which only a very short web stump 41 without bores is used.

Figure 7:
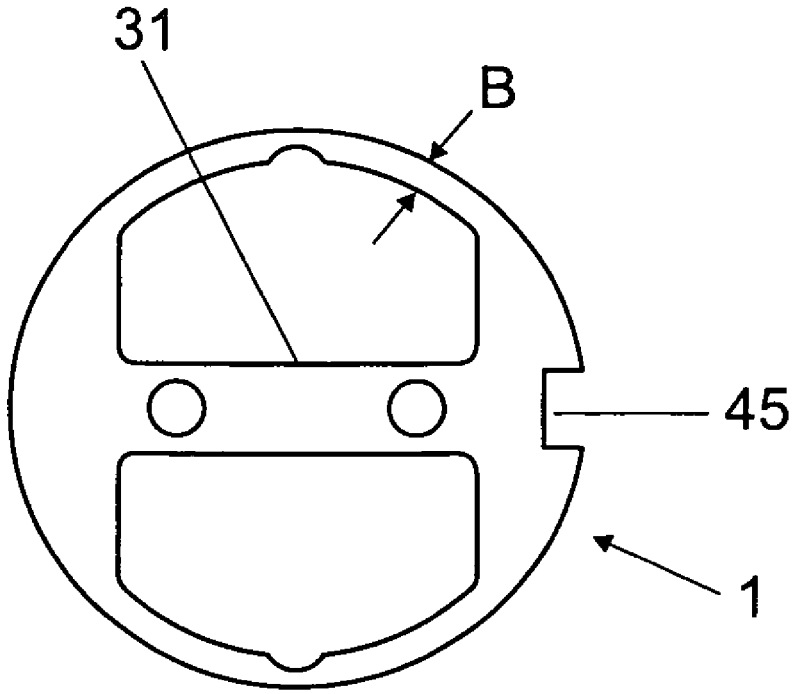

FIG. 7 shows a further exemplary embodiment of a damping element 1 in which a continuous web 31 is used; a guide groove 45 being applied on the side on the outside of the ring, level with one of the web shoulders to be precise, because there is enough flesh for the recess of the guide groove at this location. The guide groove can latch into a lug 46 of the base insulator—see FIG. 2. Here, the circular ring does not have a constant width B, but rather has two further recesses.

Figure 8:
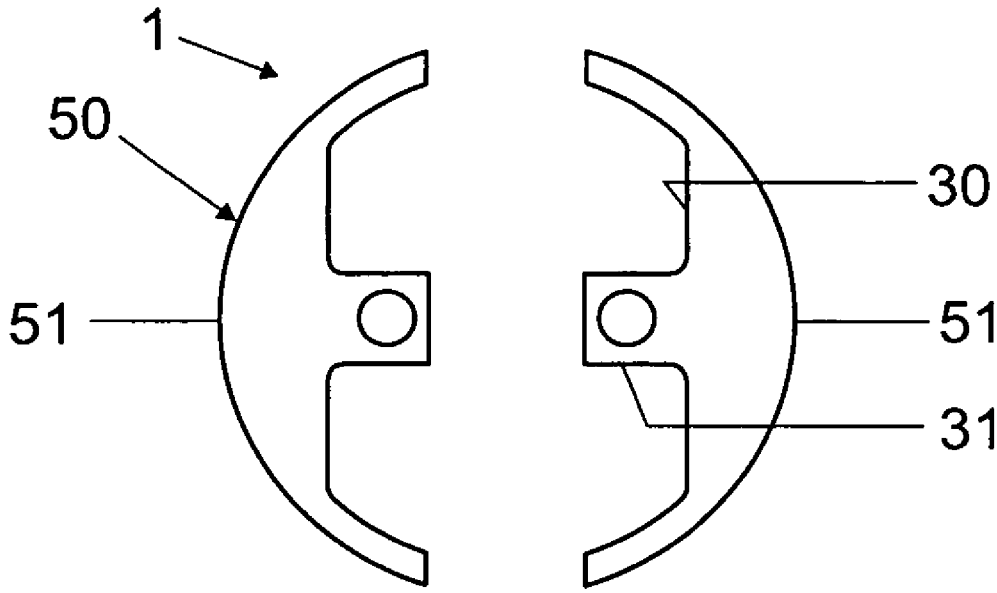

Finally, FIG. 8 shows a damping element 50 which is assembled from two parts 51. Each part is just less than half a ring and respectively has a web shoulder 30 and a web stump 31.

In general, the damping element is a ring, cut out of a disk, which has a given width B which is significantly larger than the thickness D (see FIG. 2) of the disk so that positional stabilization is achieved. A typical value of the width B is 2.5 mm, with a typical thickness of 1 mm. A typical value range of B is from 2 to 4 mm and a typical value range of D is from 0.5 to 1.5 mm. Preferably, the ratio B:D is at least 2:1. It can by all means be up to 8:1, possibly even higher. It goes without saying that this condition is still satisfied if, in parts, the width B of the damping element is of smaller design since stabilization is all that counts.

It goes without saying that the damping element can be used in the case of reflector lamps or the like, see WO2005015605. In this case, the enveloping part is the reflector.

The invention claimed is:

1. An electric lamp with a base at one end with a light bulb sealed in a vacuum-tight fashion, with the latter being surrounded by an outer bulb and an enveloping part, with a base supporting firstly the outer bulb and secondly the enveloping part, with the base having a base insulator which is produced from an insulating material and has a central opening which holds the outer bulb; with the base insulator having a circular segment with a plateau; with the enveloping part having a circular opening with a lower contact face relative to the base on the base side, the lower contact face fitting together with the plateau of the segment on the base insulator; and with the enveloping part being attached to the base insulator by a cement-free mechanical holding mechanism, and with a damping element being inserted between enveloping bulb and base insulator, characterized in that the damping element is a ring-type part cut out of a disk, referred to as ring in the following text, which in each case has a web shoulder on two opposing sides and characterized in that the damping element at the web shoulder has at least one web stump.

2. The electric lamp with a base at one end as claimed in claim 1, characterized in that the damping element is composed of two parts.

3. The electric lamp with a base at one end as claimed in claim 1, characterized in that the damping element is composed of one part.

4. The lamp as claimed in claim 1, characterized in that the damping element has a web stump provided with a bore.

5. The lamp as claimed in claim 4, characterized in that the web extends continuously from a first web shoulder to a second web shoulder.

6. An electric lamp with a base at one end with a light bulb sealed in a vacuum-tight fashion, with the latter being surrounded by an outer bulb and an enveloping part, with a base supporting firstly the outer bulb and secondly the enveloping part, with the base having a base insulator which is produced from an insulating material and has a central opening which holds the outer bulb; with the base insulator having a circular segment with a plateau; with the enveloping part having a circular opening with a lower contact face relative to the base on the base side, the lower contact face fitting together with the plateau of the segment on the base insulator; and with the enveloping part being attached to the base insulator by a cement-free mechanical holding mechanism, and with a damping element being inserted between enveloping bulb and base insulator, characterized in that the damping element is a ring-type part cut out of a disk, referred to as ring in the following text, which in each case has a web shoulder on two opposing sides and characterized in that the damping element has at least one edge-side recess.

7. The lamp as claimed in claim 1, characterized in that the damping element has a substantially ring-shaped section, in which the ratio of the width of the ring B to the thickness of the ring D is between 2:1 and 8:1.

8. The lamp as claimed in claim 1, characterized in that the damping element is produced from plastic, in particular silicone rubber or Viton or Teflon.

9. The lamp as claimed in claim 1, characterized in that the thickness of the ring D is between 0.5 and 1.5 mm, including edge values.

10. The lamp as claimed in claim 1, characterized in that the enveloping part is either a sealed bulb or has a reflector contour.

11. The lamp as claimed in claim 1, characterized in that the enveloping part is produced from glass or aluminum.

12. The lamp as claimed in claim 1 which is in the form of a high pressure lamp.

13. The lamp as claimed in claim 6 which is in the form of a high pressure lamp.

* * * * *